United States Patent [19]

Kuchuris et al.

[11] 4,003,010

[45] Jan. 11, 1977

[54] LATCH RELAY

[75] Inventors: George F. Kuchuris, Bloomingdale; Kenji Yatsushiro, Chicago, both of Ill.

[73] Assignee: The Singer Company, New York, N.Y.

[22] Filed: Dec. 2, 1975

[21] Appl. No.: 637,081

[52] U.S. Cl. ..... 335/190; 200/153 J; 335/188

[51] Int. Cl.[2] ..... H01H 3/42

[58] Field of Search ..... 335/190, 189, 188; 200/153 J

[56] References Cited

UNITED STATES PATENTS

| | | | |
|---|---|---|---|
| 2,830,149 | 4/1958 | Winans | 335/188 |
| 3,482,192 | 12/1969 | Walker | 335/190 |
| 3,728,651 | 4/1973 | Foster | 335/190 |

*Primary Examiner*—Harold Broome
*Attorney, Agent, or Firm*—Michael, Best & Friedrich

[57] ABSTRACT

When the electromagnet (relay) is energized, the plunger is pulled into the coil against the bias of the plunger spring. The pin projecting laterally from the plunger is captive in the opening in the cam pivoted on the frame. The pin moves down and strikes a ramp portion in the cam and is deflected to the bottom of the notch where it impacts the cam and rotates it to a position in which the cam surface actuates the switch actuator. The internal switch spring acting on the actuator exerts force on the cam surface and cooperates with the contour to hold the cam in either position. When the coil is de-energized, the plunger moves out and the pin is deflected by the return guide surface of the frame to pass to the opposite side of the cam centerline and into position to actuate the cam in the opposite sense when the coil is again energized.

10 Claims, 6 Drawing Figures

LATCH RELAY

BACKGROUND OF THE INVENTION

This invention relates to relay-operated switches. Such devices are, of course, old but have been characterized by somewhat elaborate construction which resulted in relatively high cost due to the large number of piece parts and consequent assembly time.

SUMMARY OF THE INVENTION

The object of this invention is to reduce the cost and increase the reliability of relay-operated switching devices. Reliability is increased by reducing the number of parts while keeping the parts simple and of such nature that precision, where required, is easily attained. As a result, assembly time is minimized and no final adjustment is required. The product can be produced for less money.

DESCRIPTION OF THE PREFERRED EMBODIMENT

Figure 1:
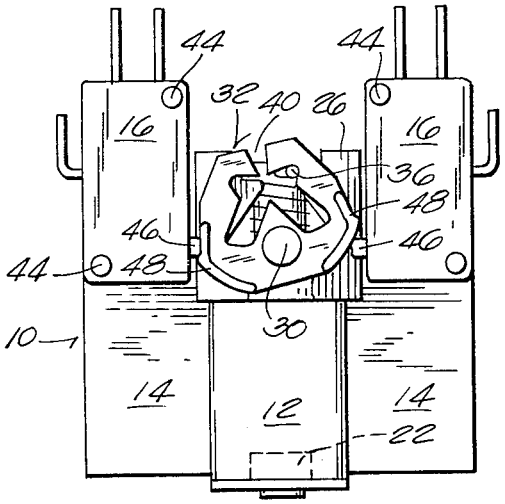
FIG. 1 is a front elevation of the relay operating two switches.

In the relay of FIG. 1 the one-piece stamped and formed frame 10 provides a mounting receptacle for coil 12 and provides side 14,14 to mount switches 16,16. Coil 12 fits between the top horizontal frame portion 18 and bottom frame portion 20 of the frame and is retained in the frame by means of backstop 22 projecting into the coil and riveted to bottom 20. The backstop also functions to increase magnetic efficacy and prevent a fall-off in the force-distance characteristic near the end of the stroke of plunger 24. Above the coil the frame is bent upwardly to provide portion 26 which is provided with a generally triangular opening 28 at the bottom center of which there is a boss portion providing for mounting pivot 30 for cam 32. Frame portion 26 also is provided with an enlarged notch 34 at the upper portion and opening into the generally triangular cutout 28.

Plunger 24 is free to rotate inside the coil and is provided with pin 36 which projects through the frame opening into opening 38 in cam 32. It will be noted that the upper portion of cam 32 is provided with split ends providing a converging slot or passage 40 into the opening 38. This is to facilitate assembly of the plunger into the coil. During assembly the pin is pressed down to spread the ends of the cam 32 until the pin reaches the opening 38 whereupon the end springs back so as to prevent exit of the pin. The pin additionally serves as a seat for spring 42 compressed between the pin and the top of frame portion 18.

It will be noted that each switch is mounted on the frame sides 14 by rivets 44. Since the rivet holes are initially stamped in the frame, this accurately locates the switch housings relative to the cam and thus accurately locates the switch actuators 46,46 relative to the cam. The cam is provided with a raised ridge-like portion 48 adjacent each actuator. This provides a larger surface against which the respective actuators bear. When the plunger is in the position shown in FIG. 1 and pin 36 is in the upper right inverted interior notch 50 in cam 32, the pin is, in effect, disposed to the right of the center of pivot 30 (or to the right of the centerline of the cam). When the coil is energized and the plunger moves down, it will impinge on the pin actuating ramp portion 52 to turn the pin further to the right until it bottoms on surface 54 of the cam opening. At this point it delivers a sharp impact to the cam and rotates the cam in a clockwise direction about its pivot 30. Motion will continue until the pin impacts on the right-hand stop surface 56 provided by the frame opening. At this moment the cam will be in the position shown in FIG. 2 and the right-hand switch actuator 46 will be depressed while the left-hand switch actuator will be in its extended position. As may be seen by referring to FIG. 5, the right-hand switch button acts against a flat portion 58 of the cam 32 and is essentially exerting a force by reason of the interior spring action in the switch itself a little below the centerline of pivot 30, thus tending to hold the cam in that position. If this force should, however, lie a little above the desired position, the cam will not return in a counterclockwise direction due to the presence of the small projection 60 on the cam. Reference to the left side of FIG. 5 shows that considering only that actuator 46 (as would be the case in FIG. 3 where only one switch is actuated by the latch-in relay) the force exerted by actuator 46 on the sloping surface 62 of the cam resolves into a force on the cam holding the cam in that position.

Figure 2:
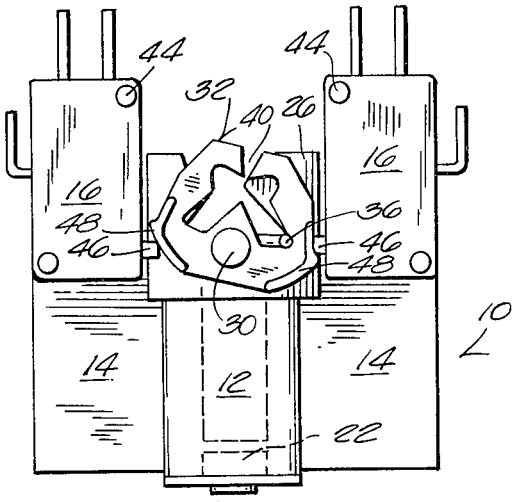
FIG. 2 is similar to FIG. 1 but shows the plunger in the down position.
Figure 5:
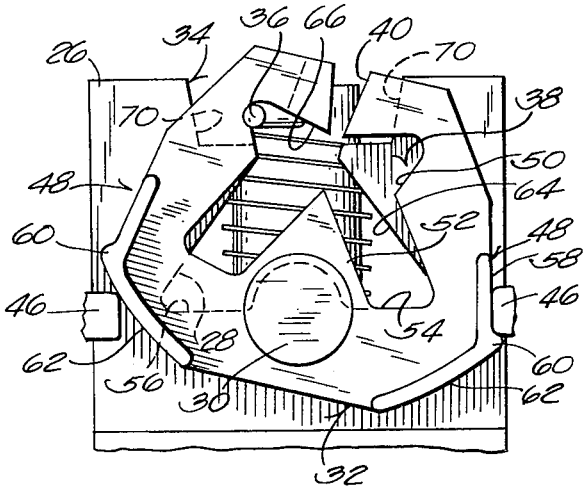
FIG. 5 is an enlarged detail of the cam and frame arrangement and showing two switch buttons in part.
Figure 4:
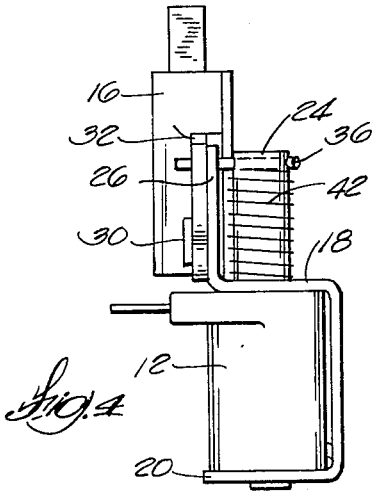
FIG. 4 is a side view of FIG. 3.
Figure 6:
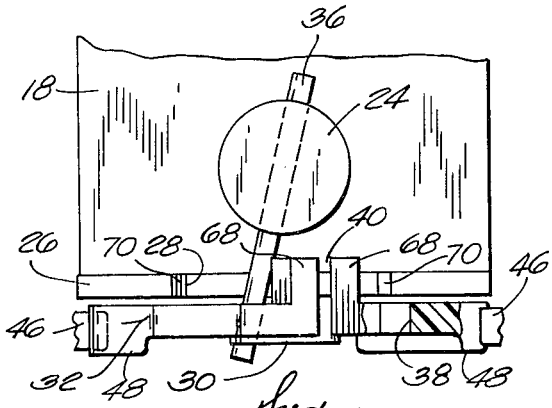
FIG. 6 is a top plan view of FIG. 5.

When the coil is de-energized from the position shown in FIG. 2, the spring starts moving the plunger upwardly and pin 36 strikes the return guide surface 64 on the inside of the frame opening and is moved to the left as seen in FIG. 5. The pin next engages the surface 66 on the inside of the cam opening which continues rotating the plunger until the pin stops in the upper left corner of the cam opening as seen in FIG. 5 and in FIG. 3. When the coil is next engaged, the plunger will obviously move down and impact the cam to rotate the cam in a counterclockwise direction.

It will be noted that the cam is provided with rearwardly projecting stops 68,68 which in either rest position of the cam will abut limiter surfaces 70,70 in the frame cutout, thus limiting the rotation of the cam in either direction.

Figure 3:
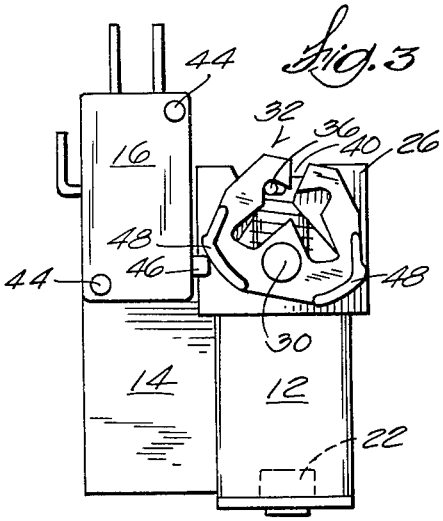
FIG. 3 is a similar front elevation but shows a single switch configuration and illustrates the position of the plunger when the coil is de-energized from the position of FIG. 2.

There is nothing critical in this design since even the location of the switch actuators relative to the center of the pivot 30 does not have any bearing on the ability of the actuators acting against either the flat or curved cam contours 48,62, respectively, to retain the cam in the desired location. Thus there is no need for adjusting the assembly when completed. Good magnetic qualities are obtained. The plunger does not impact on the backstop 22 in the down position and the desirable air gap is obtained. The coil may be operated on alternating or direct current. The device is not subject to mechanical shock causing the relay to change the operating mode. Put another way, the latching arrangement is stable in either position of the cam. The single switch configuration of FIG. 3 is just as stable as the dual switch arrangement. Obviously through selected wiring any type of operation of the switches can be attained. Since the switch actuators act generally through the pivot, the torque required to rotate the cam is minimized and the coil size is minimized. In either de-energized position the pin 36 is positioned off-center a distance which is adequate to compensate for any rotational torque imparted to the plunger by magnetic flux. Therefore, the pin will remain on the same side of the centerline when the coil is energized. By designing an air gap between the plunger 24 and the backstop 22 in the energized condition and by using a non-magnetic stainless steel pin 36, problems caused by residual magnetism are eliminated.

We claim:

1. Apparatus comprising a frame, a relay mounted in the frame and including a coil and a plunger, a spring biasing the plunger out of the coil, a generally flat cam member pivotally mounted on the frame for rocking movement between two positions and having an external cam surface and an opening therein, a pin projecting from the plunger into said cam opening, said opening providing an outer limit stop and an impact surface for said pin on each side of the cam centerline, said pin engaging either of the limit stops when the coil is de-energized and moving into engagement with the impact surface on the same side of the centerline when the coil is energized to cause the cam member to rock to a new position, means operative upon de-energization of the coil to cause the pin to move past the cam centerline into engagement with the other limit stop, a device mounted on the frame adjacent the cam member and having an actuator spring loaded into engagement with the external cam surface, said external cam surface being contoured so the actuator acting thereagainst holds the cam member in either of said two positions in a stable manner.

2. Apparatus according to claim 1 in which said means is a guide surface engaged by said pin as it returns to its outer position.

3. Apparatus according to claim 2 in which said frame is provided with an opening in general alignment with the cam opening and has one such guide surface on each side of the centerline.

4. Apparatus according to claim 3 including cooperating stop means on said cam member and said frame limiting movement of the cam member past said two positions.

5. Apparatus according to claim 4 including a stop surface on the frame on each side of the centerline engageable by said pin to limit motion of the plunger into the coil when the coil is energized.

6. Apparatus according to claim 3 in which the cam opening has a ramp surface on each side of the centerline leading from the centerline to the impact surface and engaged by the pin as the plunger moves down whereby the pin is guided to the impact surface.

7. Apparatus according to claim 3 in which the external cam surface is contoured so that in either of the two positions of the cam member the force of the actuator acting against the effective cam surface is resolved into a force acting about the cam pivot in a direction holding the cam member in its then position, the two effective cam surfaces being separated by a small projection which lends resistance to movement of the cam member from either position.

8. Apparatus according to claim 7 in which the actuator is positioned so its projection passes generally through the cam member pivot.

9. Apparatus according to claim 8 in which there are two of said devices mounted on the frame on opposite sides of the cam member.

10. Apparatus according to claim 9 in which said frame is a single piece of metal formed to magnetically embrace the coil ends.

* * * * *